US006830810B2

(12) United States Patent
Bond

(10) Patent No.: US 6,830,810 B2
(45) Date of Patent: Dec. 14, 2004

(54) COMPOSITIONS AND PROCESSES FOR REDUCING WATER SOLUBILITY OF A STARCH COMPONENT IN A MULTICOMPONENT FIBER

(75) Inventor: Eric Bryan Bond, Maineville, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 58 days.

(21) Appl. No.: 10/294,508

(22) Filed: Nov. 14, 2002

(65) Prior Publication Data

US 2004/0096656 A1 May 20, 2004

(51) Int. Cl.[7] ..... D01F 8/00
(52) U.S. Cl. ..... 428/373; 428/374
(58) Field of Search ..... 428/373, 374

(56) References Cited

U.S. PATENT DOCUMENTS

| | | | |
|---|---|---|---|
| 4,139,699 | A | 2/1979 | Hernandez et al. |
| 4,853,168 | A | 8/1989 | Eden et al. |
| 5,316,578 | A | 5/1994 | Buehler et al. |
| 5,417,679 | A | 5/1995 | Toms et al. |
| 5,422,387 | A | 6/1995 | Toms et al. |
| 5,425,987 | A | 6/1995 | Shawver et al. |
| 5,516,815 | A | 5/1996 | Buehler et al. |
| 5,593,768 | A | 1/1997 | Gessner |
| 5,593,778 | A | 1/1997 | Kondo et al. |
| 5,703,160 | A | 12/1997 | Dehennau et al. |
| 5,814,404 | A | 9/1998 | Rutherford et al. |
| 5,844,023 | A | 12/1998 | Tomka |
| 5,851,937 | A | 12/1998 | Wu et al. |
| 5,874,486 | A | 2/1999 | Bastioli et al. |
| 5,945,480 | A | 8/1999 | Wang et al. |
| 5,985,776 | A | 11/1999 | Bertrand et al. |
| 6,045,908 | A | 4/2000 | Nakajima et al. |
| 6,096,809 | A | 8/2000 | Lorcks et al. |
| 6,117,925 | A | 9/2000 | Tomka |
| 6,218,321 | B1 | 4/2001 | Lorcks et al. |
| 6,218,532 | B1 | 4/2001 | Mark et al. |
| 6,376,072 | B1 | 4/2002 | Evans et al. |
| 6,451,170 | B1 | 9/2002 | Anderson et al. |

FOREIGN PATENT DOCUMENTS

| | | | |
|---|---|---|---|
| EP | 1 035 163 | A2 | 9/2000 |
| EP | 1 035 239 | A2 | 9/2000 |
| EP | 1217106 | A1 | 6/2002 |
| EP | 1217107 | A1 | 6/2002 |
| GB | 1 247 474 | | 9/1971 |
| JP | 62-28410 | | 2/1987 |
| JP | 04100913 | | 4/1992 |
| JP | 96027627 | A | 1/1996 |
| JP | 97041224 | | 2/1997 |
| JP | 9276331 | | 10/1997 |
| JP | 1008364 | | 1/1998 |
| WO | WO 01/46506 | A2 | 6/2001 |
| WO | WO 01/48078 | A1 | 7/2001 |
| WO | WO 01/49912 | A1 | 7/2001 |

OTHER PUBLICATIONS

Fringant, C., et al., "Preparation of Mixed Esters of Starch or Use of an External Plasticizer: Two Different Ways to Change the Properties of Starch Acetate Films", Carbohydrate Polymers 35 (1998) 97–106, Elsevier Science, Ltd.

Glenn, G. M., et al., "Starch, Fiber and $CaCO_3$ Effects on the Physical Properties of Foams Made by a Baking Process," Industrial Crops and Products 14 (2001) 201–212, Elsevier Science, Ltd.

Jandura, P., et al., "The Thermal Degradation Behavior of Cellulose Fibers Partially Esterified with Some Long Chain Organic Acids", Polymer Degradation and Stability 70 (2000) 387–394, Elsevier Science, Ltd.

*Primary Examiner*—N. Edwards
(74) *Attorney, Agent, or Firm*—Angela Marie Stone

(57) ABSTRACT

A melt spinnable multicomponent fiber is provided that comprises a first component comprising a starch insolubilizing agent and a thermoplastic polymer, and a second component comprising destructurized starch and a plasticizer. The insolubilizing agent acts on the starch of the second component to render the starch less soluble when the fiber is exposed to water. The invention is also directed to nonwoven webs and disposable articles comprising the multicomponent fibers.

18 Claims, 5 Drawing Sheets

COMPOSITIONS AND PROCESSES FOR REDUCING WATER SOLUBILITY OF A STARCH COMPONENT IN A MULTICOMPONENT FIBER

FIELD OF THE INVENTION

The present invention relates to multicomponent fibers comprising starch and polymers, in particular, where a starch component has been at least partially insolubilized by exposure to an insolubilizing agent initially present in a polymer component of the fiber. The fibers can be used to make nonwoven webs and disposable articles.

BACKGROUND OF THE INVENTION

There has not been much success at making starch containing fibers on a high speed, industrial level due to many factors. Because of the costs, the difficulty in processing, and end-use properties, there has been little or no commercial success. Starch fibers are much more difficult to produce than films, blow-molded articles, and injection-molded articles containing starch. This is because of the short processing time required for starch processing due to rapid crystallization or other structure formation characteristics of starch. The local strain rates and shear rates are much greater in fiber production than in other processes. Additionally, a homogeneous composition is required for fiber spinning. For spinning fine fibers, small defects, slight inconsistencies, or non-homogeneity in the melt are not acceptable for a commercially viable process. Therefore, the selection of materials, configuration of the fibers, and processing conditions are critical. In addition to the difficulty during processing, the end-use properties are not suitable for many commercial applications. This is because the starch fibers typically have low tensile strength and are sticky.

To produce fibers that have more acceptable processability and end-use properties, it is desirable to use non-starch thermoplastic polymers in combination with starch. The melting temperature of the thermoplastic polymer should be high enough for end-use stability, to prevent melting or undue structural deformation during use, but low enough so that the composite fibers are processable with starch.

There exists today an unmet need for cost-effective, easily processable, and functional starch-containing fibers that also have acceptable water resistance. Although methods exist for rendering thermoplastic compositions containing starch more insoluble by, for example, cross-linking such as in U.S. Pat. No. 6,218,532, Apr. 17, 2001 to Mark et al., such crosslinking adversely affects the processibility of starch bicomponent fibers. The fibers produced by Mark et al. are crosslinked before processing, thereby limiting their processability and their overall ability to be produced in small diameters. U.S. Pat. No. 5,874,486 to Bastioli et al., Feb. 23, 1999, relates to polymeric compositions comprising a matrix including a starch component and a thermoplastic polymer in which a high level of filler is dispersed in starch. U.S. Pat. No. 5,844,023 to Tomka, Dec. 1, 1998, relates to a polymer dispersion consisting essentially of starch dispered as a discontinuous component and at least one specific polymer.

The present invention addresses the problem of mass loss of starch from the starch component of a multicomponent fiber in the presence of water.

SUMMARY OF THE INVENTION

The present invention is directed to melt spinnable multicomponent fibers comprising a first component and a second component. The first component comprises a starch insolubilizing agent and a thermoplastic polymer and the second component comprises destructurized, typically, thermoplastic starch. The insolubilizing agent acts on the starch of the second component to render the starch less soluble when the fiber is exposed to water. Such interaction may include diffusion of the insolubilization agent from the first component across the interface to render neighboring starch regions insoluble, may include diffusion of the insolubilization agent throughout the second starch component to reach an equilibrium of agent throughout the fiber, a diffusion gradient thereformed, or may include chemical reactions with the starch, for example. The resultant fiber loses less starch when in contact with water than a similar fiber without the insolubilization agent. A difficulty with adding the insolubilization agent to the second component during processing is that such a composition has very poor spinnability. An embodiment of the invention is the resultant fiber after action of the insolubilizing agent on the starch of the second component. Such a fiber comprises a second component which comprises destructured insolubilized starch or, typically, thermoplastic insolubilized starch.

The configuration of the multicomponent fibers can be sheath-core, islands-in-the-sea, side-by-side, segmented pie, for example, or various combination thereof. In the embodiments where starch is present in the component potentially having contact with water, i.e., the sheath of a sheath-core configuration, for example, soluble starch can be removed upon contact with water. However, in such a configuration, insolubilized starch can remain in the sheath component to form a coating around the core component.

Such compositions are cost-effective, suitable for use in commercially available equipment, while possessing a significant amount of the total composition that is biodegradable. Fibers of the present invention have a higher wet strength and lower water solubility than existing fibers. The resultant at least partially insolubilized starch of the multicomponent fibers of the invention has less starch loss when placed in contact with water as compared to existing fibers. The present invention is also directed to nonwoven webs and disposable articles comprising said multicomponent fibers. The nonwoven webs may also contain other synthetic or natural fibers blended with the fibers of the present invention.

BRIEF DESCRIPTION OF THE DRAWINGS

These and other features, aspects, and advantages of the present invention will become better understood with regard to the following description, appended claims, and accompanying drawings. In the drawings, component X is the second component and component Y is the first component. For inverted embodiments, component X is the first component and component Y is the second component.

FIG. 1A illustrates a typical concentric sheath-core configuration.

FIG. 1B illustrates a sheath-core configuration with a solid core and shaped continuous sheath.

FIG. 1C illustrates a sheath-core configuration with a hollow core, core x, and continuous sheath y.

FIG. 1D illustrates a sheath-core configuration with a hollow core, core x, and shaped continuous sheath y.

FIG. 1E illustrates a discontinuous sheath-core configuration.

FIG. 1F illustrates a further discontinuous sheath-core configuration.

FIG. 1G illustrates a sheath-core configuration with hollow core surrounded by component X and discontinuous sheath component Y.

FIG. 1H illustrates a further sheath-core configuration with hollow core surrounded by component X and discontinuous sheath component Y.

FIG. 1I illustrates an eccentric sheath-core configuration.

FIG. 2A illustrates a solid eight segmented pie configuration.

FIG. 2B illustrates a hollow eight segmented pie configuration.

FIG. 4 provides schematic drawings illustrating a cross-sectional view of a bicomponent fiber having a side-by-side configuration.

FIG. 5A illustrates a solid islands-in the-sea configuration with component X surrounded by component Y. Component X may be triangular in shape.

FIG. 5B illustrates a solid islands-in the-sea configuration with component X surrounded by component Y.

FIG. 5C illustrates a hollow islands-in the-sea configuration with component X surrounded by component Y.

DETAILED DESCRIPTION OF THE INVENTION

Figure 1A:
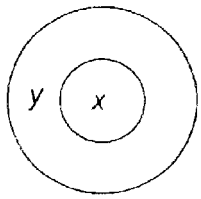
FIG. 1A-FIG. 1I provide schematic drawings illustrating cross-sectional views of multicomponent fibers.

All percentages, ratios and proportions used herein are by weight percent of the composition, unless otherwise specified. All average values are calculated "by weight" of the composition or components thereof, unless otherwise expressly indicated. "Average molecular weight", or "molecular weight" for polymers, unless otherwise indicated, refers to number average molecular weight. Number average molecular weight, unless otherwise specified, is determined by gel permeation chromatography. All patents or other publications cited herein are incorporated herein by reference with respect to all text contained therein for the purposes for which the reference was cited. Inclusion of any such patents or publications is not intended to be an admission that the cited reference is citable as prior art or that the subject matter therein is material prior art against the present invention.

The specification contains a detailed description of (1) materials for the multicomponent fibers of the present invention, (2) configuration of the multicomponent fibers, (3) material properties of the multicomponent fiber, (4) processes, and (5) articles.

(1) Materials

First Component Material: Thermoplastic Polymers

The thermoplastic polymer has a melting temperature sufficiently low to prevent significant degradation of the starch during compounding and yet be sufficiently high for thermal stability during use of the fiber. Suitable melting temperatures of the thermoplastic polymers are from about 60° C. to about 250° C. and preferably from about 90° C. to about 215° C. Thermoplastic polymers having a melting temperature (Tm) above 250° C. may be used if plasticizers or diluents or other polymers are used to lower the observed melting temperature, such that the melting temperature of the composition of the thermoplastic polymer-containing component is within the above ranges. It may be desired to use a thermoplastic polymer having a glass transition (Tg) temperature of less than 0° C. The thermoplastic polymer component has rheological characteristics suitable for melt spinning. The molecular weight of the polymer should be sufficiently high to enable entanglement between polymer molecules and yet low enough to be melt spinnable. For melt spinning, suitable thermoplastic polymers can have molecular weights about 1,000,000 g/mol or below, preferably from about 5,000 g/mol to about 800,000 g/mol, more preferable from about 10,000 g/mol to about 700,000 g/mol and most preferably from about 20,000 g/mol to about 500,000 g/mol.

The thermoplastic polymers should be able to solidify fairly rapidly, preferably under extensional flow, as typically encountered in known processes as staple fibers (spin draw process) or spunbond/meltblown continuous filament process, and desirably can form a thermally stable fiber structure. "Thermally stable fiber structure" as used herein is defined as not exhibiting significant melting or dimensional change at 25° C. and ambient atmospheric pressure over a period of 24 hours at 50% relative humidity when the fibers are placed in the environment within five minutes of their formation. Dimensional changes in measured fiber diameter greater than 25% difference, using as a basis the corresponding, original fiber diameter measurement, would be considered significant. If the original fiber is not round, the shortest diameter should be used for the calculation. The shortest diameter should be used for the post-24 hour measurement also.

Suitable thermoplastic polymers include polyolefins such as polyethylene or copolymers thereof, including low, high, linear low, or ultra low density polyethylenes, polypropylene or copolymers thereof, including atactic polypropylene; polybutylene or copolymers thereof; polyamides or copolymers thereof, such as Nylon 6, Nylon 11, Nylon 12, Nylon 46, Nylon 66; polyesters or copolymers thereof, such as polyethylene terephalates; olefin carboxylic acid copolymers such as ethylene/acrylic acid copolymer, ethylene/maleic acid copolymer, ethylene/methacrylic acid copolymer, ethylene/vinyl acetate copolymers or combinations thereof, polyacrylates, polymethacrylates, and their copolymers such as poly(methyl methacrylates). Other non-limiting examples of polymers include polycarbonates, polyvinyl acetates, poly(oxymethylene), styrene copolymers, polyacrylates, polymethacrylates, poly(methyl methacrylates), polystyrene/methyl methacrylate copolymers, polyetherimides, polysulfones, or combinations thereof. In some embodiments, thermoplastic polymers include polypropylene, polyethylene, polyamides, polyvinyl alcohol, ethylene acrylic acid, polyolefin carboxylic acid copolymers, polyesters, and combinations thereof.

Biodegradable thermoplastic polymers are also suitable for use herein. Biodegradable materials are susceptible to being assimilated by microorganisms such as molds, fungi, and bacteria when the biodegradable material is buried in the ground or otherwise comes in contact with the microorganisms including contact under environmental conditions conducive to the growth of the microorganisms. Suitable biodegradable polymers also include those biodegradable materials which are environmentally degradable using aerobic or anaerobic digestion procedures, or by virtue of being exposed to environmental elements such as sunlight, rain, moisture, wind, temperature, and the like. The biodegradable thermoplastic polymers can be used individually or as a combination of biodegradable or non-biodegradable polymers. Biodegradable polymers include polyesters containing aliphatic components. Among the polyesters are ester polycondensates containing aliphatic constituents and poly (hydroxycarboxylic) acid. The ester polycondensates include diacids/diol aliphatic polyesters such as polybutylene succinate, polybutylene succinate co-adipate, aliphatic/aromatic polyesters such as terpolymers made of butylenes diol, adipic acid and terephtalic acid. The poly (hydroxycarboxylic) acids include lactic acid based homopolymers and copolymers, polyhydroxybutyrate (PHB), or other polyhydroxyalkanoate homopolymers and copolymers. Such polyhydroxyalkanoates include copolymers of PHB with higher chain length monomers, such as C6–C12, and higher.

An example of a suitable commercially available poly lactic acid is NATUREWORKS from Cargill Dow and LACEA from Mitsui Chemical. An example of a suitable commercially available diacid/diol aliphatic polyester is the polybutylene succinate/adipate copolymers sold as BIONOLLE 1000 and BIONOLLE 3000 from the Showa High Polymer Company, Ltd. (Tokyo, Japan). An example of a suitable commercially available aliphatic/aromatic copolyester is the poly(tetramethylene adipate-co-terephthalate) sold as EASTAR BIO Copolyester from Eastman Chemical or ECOFLEX from BASF.

The selection of the polymer and amount of polymer will effect the softness, texture, and properties of the final product as will be understood by those or ordinary skill in the art. The thermoplastic polymer component can contain a single polymer species or a blend of two or more non-starch thermoplastic polymers. Additionally, other materials can be present in the thermoplastic polymer component. Typically, thermoplastic polymers are present in an amount of from about 51% to 100%, preferably from about 60% to about 95%, more preferably from about 70% to about 90%, by total weight of the thermoplastic polymer component.

Additional First Component Material: Starch Insolubilizing Agent

A starch insolubilizing agent is a chemical species that renders destructurized starch less water soluble than such starch absent the agent. The agent is also able to render such insolubilization across the interface of two components of a multicomponent structured fiber. The agent may have a physical association with the starch that causes the insolubility or a chemical reaction with the starch may occur to derivatize the starch or crosslink the starch to cause insolubility. In either event, a special, electronic, chemical bonding, hydrogen bonding, crosslinking, or physical entanglement occurs to render the starch less water soluble than in the absence of the agent.

The agent is provided in a first component that also includes the thermoplastic polymer. The agent may diffuse from the first component across the multicomponent interface to render neighboring starch regions in a second component insoluble, may diffuse throughout the second starch component to reach an equilibrium of agent throughout the fiber and in the process provide a diffusion gradient, or may chemically react with the starch, for example, by crosslinking. The resultant fiber has significantly less starch water solubility than a fiber without the insolubilization agent present. A difficulty with adding the insolubilization agent to the second component during processing is that such a composition has very poor spinnability. The effects of the solubilizing agent are measured by at least a partial reduction of water solubility of the starch component.

Examples of an insolubilizing agent include aliphatic or aromatic carboxylic acids or carboxyamides having a melting temperature above room temperature (25° C.) and below the upper processing temperature of thermoplastic starch of about 275° C. and a minimum boiling point temperature greater than 200° C. Such insolubilizing agents include saturated or unsaturated C8–C22 fatty acids such as caprylic, oleic, palmitic, stearic, linoleic, linolenic, ricinoleic, erucic acids, or the corresponding fatty acid alcohols or amides of the fatty acids listed above, in particular, mono-,di-, or tri-glycerides of the said fatty acids. Examples of suitable aliphatic or aromatic carboxyamides are stearamide, benzamide, or propionamide, for example.

Crosslinking agents known in the art may also be used as insolubilizing agents. Such crosslinking agents may be bi- or polyfunctional reagents used to covalently bridge, or crosslink, two starch molecules at various locations along their chains. Examples include formaldehyde, epichlorohydrin, phosphoric acid, acrolein, isocyanate, epoxy, anhydride, or a mixture thereof, for example. Further, ultraviolet or infrared initiated crosslinking reactions may be used where the incident radiation produces free radicals that then crosslink the starch matrix. The crosslinking reactions can also occur between the starch and starch plasticizers, among starch plasticizers, and the thermoplastic polymer and starch or starch plasticizers or various combinations thereof in isolation or as distributions thereof. All of these reactions, so long as they reduce the mass loss of the fiber, have equivalent meaning.

A starch insolubilizing agent may be present in the first component in quantities of less than about 50%, from about 0.1% to about 40% or, typically, from about 0.1% to about 15% or 0.1% to about 30% by weight of the composition.

Second Component Material: Destructurized Starch

The present invention relates to the use of starch, a low cost naturally occurring biopolymer. The starch used in the present invention is thermoplastic, destructured starch. The term "destructurized starch" is used to mean starch that is no longer in its naturally occurring granular structure. The term "thermoplastic starch" or "TPS" is used to mean starch with a plasticizer for improving its thermoplastic flow properties so that it may be able to be spun into fibers.

Natural starch does not melt or flow like conventional thermoplastic polymers. Since natural starch generally has a granular structure, it needs to be "destructurized", or "destructured", before it can be melt processed and spun like a thermoplastic material. Without intending to be bound by theory, the granular structure of starch is characterized by granules comprising an structure of discrete amylopectin and amylose regions in a starch granule. This granular structure is broken down during destructurization, which can be followed by observing a volume expansion of the starch component in he presence of the solvent or plasticizer. Starch undergoing destructuring in the presence of the solvent or plasticizer also typically has an increase in viscosity versus non-destructured starch with the solvent or plasticizer. The resulting destructurized starch can be in gelatinized form or, upon drying and or annealing, in crystalline form, however once broken down the natural granular structure of starch will not, in general, return. It is desirable that the starch be fully destructured such that no lumps impacting the fiber spinning process are present. The destructuring agent used to destructure the starch may remain with the starch during further processing, or may be transient, in that it is removed such that it does not remain in the fiber spun with the starch.

Starch can be destructured in a variety of different ways. The starch can be destructurized with a solvent. For example, starch can be destructurized by subjecting a mixture of the starch and solvent to heat, which can be under pressurized conditions and shear, to gelatinize the starch, leading to destructurization. Solvents can also act as plasticizers and may be desirably retained in the composition to perform as a plasticizer during later processing. A variety of plasticizing agents that can act as solvents to destructure starch are described herein. These include the low molecular weight or monomeric plasticizers, such as but not limited to hydroxyl-containing plasticizers, including but not limited to the polyols, e.g. polyols such as mannitol, sorbitol, and glycerin. Water also can act as a solvent and plasticizer for starch.

For starch to flow and be melt spinnable like a conventional thermoplastic polymer, it should have plasticizer present. If the destructuring agent is removed, it is the nature of the starch to in general remain destructured, however a plasticizer should be added to or otherwise included in the starch component to impart thermoplastic properties to the starch component in order to facilitate fiber spinning. Thus, the plasticizer present during spinning may be the same one used to destructure the starch. Alternately, especially when the destructuring agent is transient as described above (for example, water), a separate or additional plasticizer may be added to the starch. Such additional plasticizer can be added prior to, during, or after the starch is destructured, as long as it remains in the starch for the fiber spinning step.

Suitable naturally occurring starches can include, but are not limited to, corn starch, potato starch, sweet potato starch, wheat starch, sago palm starch, tapioca starch, rice starch, soybean starch, arrow root starch, bracken starch, lotus starch, cassava starch, waxy maize starch, high amylose corn starch, and commercial amylose powder. Blends of starch may also be used. Though all starches are useful herein, the present invention is most commonly practiced with natural starches derived from agricultural sources, which offer the advantages of being abundant in supply, easily replenishable and inexpensive in price. Naturally occurring starches, particularly corn starch, wheat starch, and waxy maize starch, are the preferred starch polymers of choice due to their economy and availability.

Modified starch may also be used. Modified starch is defined as non-substituted, or substituted, starch that has had its native molecular weight characteristics changed (i.e. the molecular weight is changed but no other changes are necessarily made to the starch). Molecular weight can be modified, preferably reduced, by any technique numerous of which are well known in the art. These include, for example, chemical modifications of starch by, for example, acid or alkali hydrolysis, acid reduction, oxidative reduction, enzymatic reduction, physical/mechanical degradation (e.g., via the thermomechanical energy input of the processing equipment), or combinations thereof. The thermomechanical method and the oxidation method offer an additional advantage when carried out in situ. The exact chemical nature of the starch and molecular weight reduction method is not critical as long as the average molecular weight is provided at the desired level or range. Such techniques can also reduce molecular weight distribution.

Natural, unmodified starch generally has a very high average molecular weight and a broad molecular weight distribution (e.g. natural corn starch has an average molecular weight of up to about 60,000,000 grams/mole (g/mol)). It is desirable to reduce the molecular weight of the starch for use in the present invention. Molecular weight reduction can be obtained by any technique known in the art, including those discussed above. Ranges of molecular weight for destructured starch or starch blends added to the melt can be from about 3,000 g/mol to about 8,000,000 g/mol, preferably from about 10,000 g/mol to about 5,000,000 g/mol, and more preferably from about 20,000 g/mol to about 3,000,000 g/mol.

Optionally, substituted starch can be used. Chemical modifications of starch to provide substituted starch include, but are not limited to, etherification and esterification. For example, methyl, ethyl, or propyl (or larger aliphatic groups) can be substituted onto the starch using conventional etherification and esterification techniques as well known in the art. Such substitution can be done when the starch is in natural, granular form or after it has been destructured. Substitution can reduce the rate of biodegradability of the starch, but can also reduce the time, temperature, shear, and/or pressure conditions for destructurization. The degree of substitution of the chemically substituted starch is typically, but not necessarily, from about 0.01 to about 3.0, and can also be from about 0.01 to about 0.06.

Typically, the thermoplastic starch comprises from about 51% to about 100%, preferably from about 60% to about 95%, more preferably from about 70% to about 90% by weight of the thermoplastic starch component. The ratio of the starch component to the thermoplastic polymer will determine the percent of thermoplastic starch in the bicomponent fiber component. The weight of starch in the composition includes starch and its naturally occurring bound water content. The term "bound water" means the water found naturally occurring in starch and before mixing of starch with other components to make the composition of the present invention. The term "free water" means the water that is added in making the composition of the present invention. A person of ordinary skill in the art would recognize that once the components are mixed in a composition, water can no longer be distinguished by its origin. Natural starch typically has a bound water content of about 5% to about 16% by weight of starch.

Plasticizer

One or more plasticizers can be used in the present invention to destructurize the starch and enable the starch to flow, i.e. create a thermoplastic starch. As discussed above, a plasticizer may be used as a destructuring agent for starch. That plasticizer may remain in the destructured starch component to function as a plasticizer for the thermoplastic starch, or may be removed and substituted with a different plasticizer in the thermoplastic starch component. The plasticizers may also improve the flexibility of the final products, which is believed to be due to the lowering of the glass transition temperature of the composition.

A plasticizer or diluent for the thermoplastic polymer component may be present to lower the polymer's melting temperature, modify flexibility of the final product, or improve overall compatibility with the thermoplastic starch blend. Furthermore, thermoplastic polymers with higher melting temperatures may be used if plasticizers or diluents are present which suppress the melting temperature of the polymer.

In general, the plasticizers should be substantially compatible with the polymeric components of the present invention with which they are intermixed. As used herein, the term "substantially compatible" means when heated to a temperature above the softening and/or the melting temperature of the composition, the plasticizer is capable of forming a homogeneous mixture with polymer present in the component in which it is intermixed.

The plasticizers herein can include monomeric compounds and polymers. The polymeric plasticizers will typically have a molecular weight less than 500,000 g/mol. Polymeric plasticizers can include block copolymers and random copolymers, including terpolymers thereof. In certain embodiments, the plasticizer has a low molecular weight plasticizer, for example a molecular weight of about 20,000 g/mol or less, or about 5,000 g/mol or less, or about 1,000 g/mol or less. The plasticizers may be used alone or more than one plasticizer may be used in any particular component of the present invention.

The plasticizer can be, for example, an organic compound having at least one hydroxyl group, including polyols having two or more hydroxyls. Nonlimiting examples of useful hydroxyl plasticizers include sugars such as glucose, sucrose, fructose, raffinose, maltodextrose, galactose, xylose, maltose, lactose, mannose erythrose, and pentaerythritol; sugar alcohols such as erythritol, xylitol, malitol, mannitol and sorbitol; polyols such as glycerol (glycerin), ethylene glycol, propylene glycol, dipropylene glycol, butylene glycol, hexane triol, and the like, and polymers thereof; and mixtures thereof. Suitable plasticizers especially include glycerine, mannitol, and sorbitol.

Also useful herein hydroxyl polymeric plasticizers such as poloxomers (polyoxyethylene/polyoxypropylene block copolymers) and poloxamines (polyoxyethylene/polyoxypropylene block copolymers of ethylene diamine). These copolymers are available as PLURONIC® from BASF Corp., Parsippany, N.J. Suitable poloxamers and poloxamines are available as SYNPERONIC® from ICI Chemicals, Wilmington, Del., or as TETRONIC® from BASF Corp., Parsippany, N.J.

Also suitable for use herein are hydrogen bond forming organic compounds, including those which do not have hydroxyl group, including urea and urea derivatives; anhydrides of sugar alcohols such as sorbitan; animal proteins such as gelatin; vegetable proteins such as sunflower protein, soybean proteins, cotton seed proteins; and mixtures thereof. Other suitable plasticizers are phthalate esters, dimethyl and diethylsuccinate and related esters, glycerol triacetate, glycerol mono and diacetates, glycerol mono, di, and tripropionates, butanoates, stearates, lactic acid esters, citric acid esters, adipic acid esters, stearic acid esters, oleic acid esters, and other father acid esters which are biodegradable. Aliphatic acids such as ethylene acrylic acid, ethylene maleic acid, butadiene acrylic acid, butadiene maleic acid, propylene acrylic acid, propylene maleic acid, and other hydrocarbon based acids are further examples of plasticizers.

The amount of plasticizer is dependent upon the molecular weight and amount of starch and the affinity of the plasticizer for the starch or thermoplastic polymer. An amount that effectively plasticizes the polymer component can be used. The plasticizer should sufficiently plasticize the starch component so that it can be processed effectively to form fibers. Generally, the amount of plasticizer increases with increasing molecular weight of starch. Typically, the plasticizer can be present in an amount of from about 2% to about 70%, and can also be from about 5% to about 55%, or from about 10% to about 50% of the component into which it is intermixed. A polymer incorporated into the starch component that functions as a plasticizer for the starch shall be counted as part of the plasticizer constituent of that component of the present invention. Plasticizer is optional for the thermoplastic polymer components in the present invention, and zero percent or amounts below 2% are not meant to be excluded.

Optional Materials

Optionally, other ingredients may be incorporated into the first or second component compositions. These optional ingredients may be present in quantities of less than about 50%, or in alternative embodiments, from about 0.1% to about 30%, or from about 0.1% to about 10% by weight of the component. The optional materials may be used to modify the processability and/or to modify physical properties such as elasticity, tensile strength and modulus of the final product. Other benefits include, but are not limited to, stability including oxidative stability, brightness, color, flexibility, resiliency, workability, processing aids, viscosity modifiers, and odor control. Optional ingredients include nucleating agents, salts, slip agents, crystallization accelerators or retarders, odor masking agents, cross-linking agents, emulsifiers, surfactants, cyclodextrins, lubricants, other processing aids, optical brighteners, antioxidants, flame retardants, dyes, pigments, fillers, proteins and their alkali salts, waxes, tackifying resins, extenders, wet-strength resins, or mixtures thereof. Processing aids include magnesium stearate or, particularly in the starch component, ethylene acrylic acid.

(2) Configuration

The multiconstituent, multicomponent fibers of the present invention may be in several different configurations. Constituent, as used herein, is defined as meaning the chemical species of matter or the material. Multiconstituent, as used herein, is defined to mean a fiber or component thereof containing more than one chemical species or material. The fibers will be multicomponent in configuration. Component, as used herein, is defined as a separate part of the fiber that has a spatial relationship to another part of the fiber. The term multicomponent, as used herein, is defined as a fiber having more than one separate part in spatial relationship to one another. The term multicomponent includes bicomponent, which is defined as a fiber having two separate parts in a spatial relationship to one another. The different components of multicomponent fibers are arranged in substantially distinct regions across the cross-section of the fiber and extend continuously along the length of the fiber. The multicomponent fibers may have two, three, four or more components, as long as a first component comprising a starch insolubilizing agent and a thermoplastic polymer neighbors a second component comprising thermoplastic starch. Accordingly, reference to a first component and a second component is not meant to exclude other components, unless otherwise expressly indicated. The drawings provide reference to a component, x, y, z, and w, for example. Components z and w may be third and fourth components and may comprise another thermoplastic polymer or thermoplastic blend, for example that provides enhanced physical properties beyond the combination of a first and second component.

In one embodiment, the first component comprising the thermoplastic polymer and starch insolubilizing agent surrounds the second component such as in, for example, a sheath-core configuration where the sheath is the first component and the core is the second component.

While a sheath-core configuration such as set forth in the preceding paragraph is presented in the examples herein, other configurations where the second component is exposed to the "outside" are also contemplated for the present invention. For example, configurations where the first component does not completely surround the second component, a segmented pie configuration, or an inverted sheath/core configuration where the starch is the sheath each provide for exposure of a starch containing component to the "outside". By "outside" is meant, for example, exposure to water when the fiber is placed in water. In this embodiment, the starch insolubilizing agent of the first component forms a layer of insolubilized starch nearest the first component-second component interface, thereby providing water insoluble starch coating at the interface. The soluble starch is washed away by exposure to water to alter the surface energetics of the thermoplastic polymer surface when the fiber is placed in water, for example.

Figure 1B:
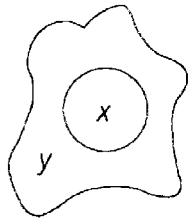
Figure 1C:
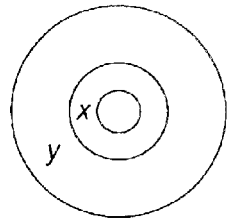
Figure 1D:
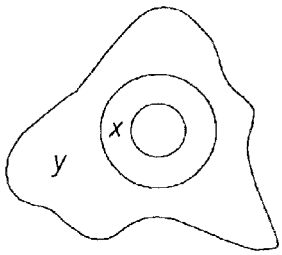
Figure 1E:
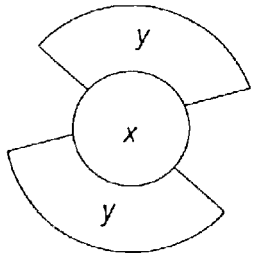
Figure 1F:
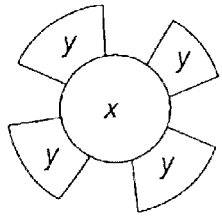
Figure 1G:
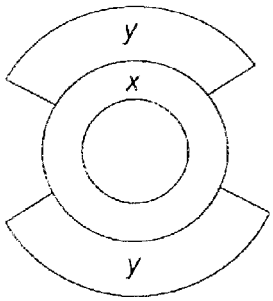
Figure 1H:
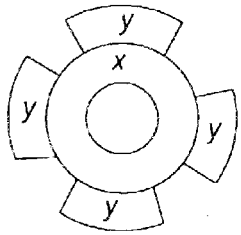
Figure 1I:
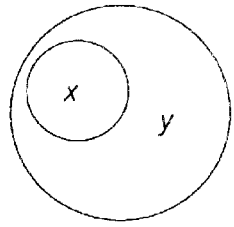
Figure 2A:
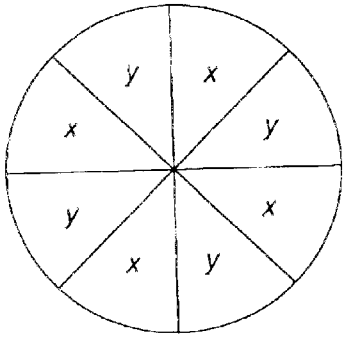
FIG. 2A-FIG. 2B provide schematic drawings illustrating cross-sectional views of bicomponent fibers having a segmented pie configuration.
Figure 2B:
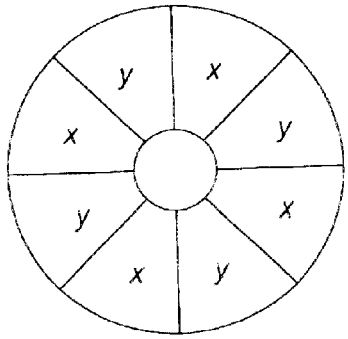
Figure 3:
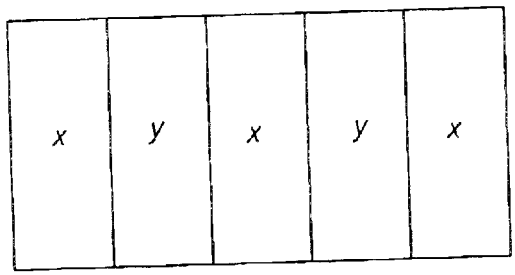
FIG. 3 provides a schematic drawing illustrating a cross-sectional view of a bicomponent fiber having a ribbon configuration.
Figure 4A:
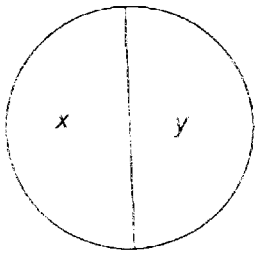
FIG. 4A illustrates a side-by-side configuration.
Figure 4B:
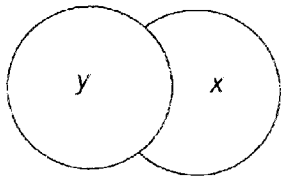
FIG. 4B illustrates a side-by-side configuration with a rounded adjoining line. The adjoining line is where two components meet. Component Y is present in a higher amount than Component X.
Figure 4C:
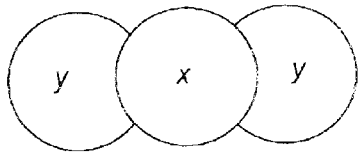
FIG. 4C illustrates a side-by-side configuration with component Y positioned on both sides of Component X with a rounded adjoining line.
Figure 4D:
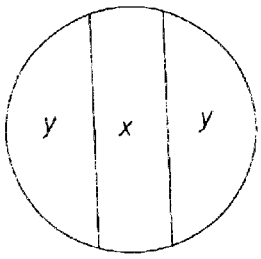
FIG. 4D illustrates a side-by-side configuration with component Y positioned on both sides of Component X.
Figure 4E:
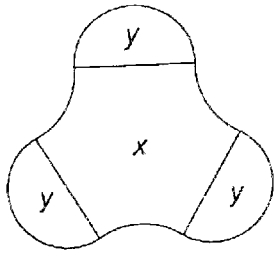
FIG. 4E illustrates a shaped side-by-side configuration with component Y positioned on the tips of component X.
Figure 5A:
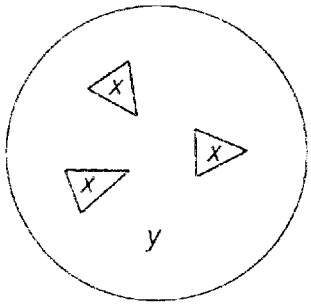
FIG. 5A-FIG. 5C provide schematic drawings illustrating cross-sectional views of multicomponent fibers having an islands-in-the-sea configuration.
Figure 5B:
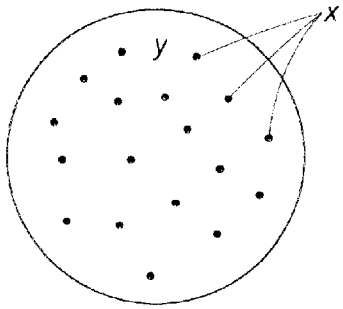
Figure 5C:
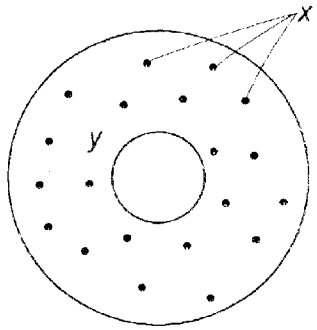
Figure 6:
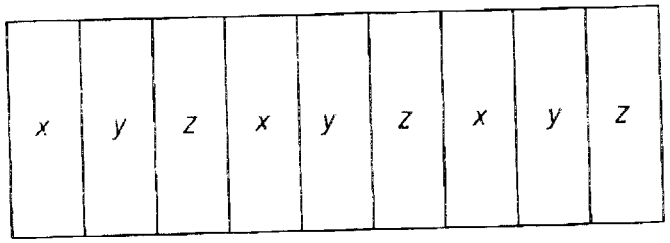
FIG. 6 provides a schematic drawing illustrating a cross-sectional view of a tricomponent fiber having a ribbon configuration.
Figure 7:
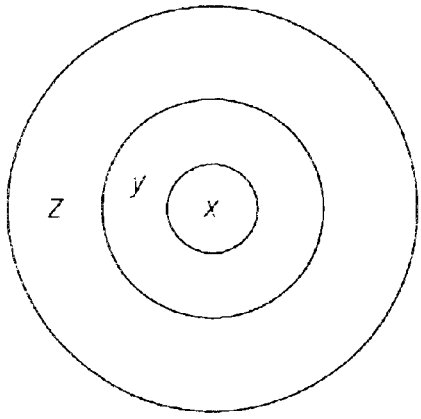
FIG. 7 provides a schematic drawing illustrating a cross-sectional view of a tricomponent fiber having a concentric sheath-core configuration with component X comprising the solid core, component Y comprising the inside continuous sheath, and component Z comprising the outside continuous sheath.
Figure 8:
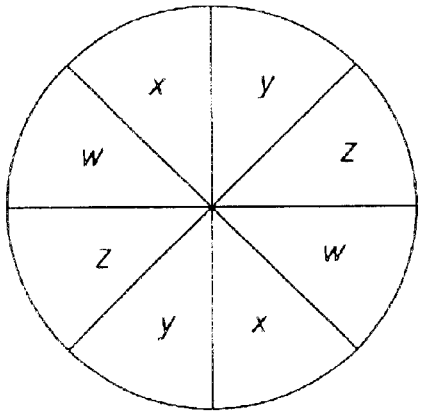
FIG. 8 provides a schematic drawing illustrating a cross-sectional view of a multicomponent fiber having a solid eight segmented pie configuration.
Figure 9:
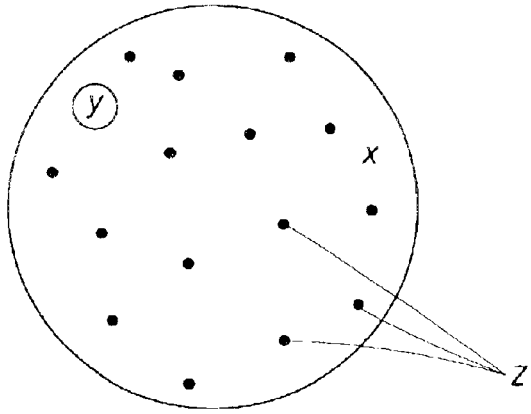
FIG. 9 provides a schematic drawing illustrating a cross-sectional view of a tricomponent fiber having a solid islands-in-the-sea configuration. Component X surrounds a single island of component Y and a plurality of islands of component Z.

FIG. 1A-FIG. 9 provide schematic drawings illustrating cross-sectional views of various configurations of multicomponent fibers. A combination of one or more configurations is also an aspect of the present invention.

The weight ratio of the second component to the first component can be from about 5:95 to about 95:5. In alternate embodiments, the ratio is from about 10:90 to about 65:35 or from about 15:85 to about 50:50.

(3) Material Properties

The diameter of the fiber of the present invention is less than about 200 micrometers (microns), and alternate embodiments can be less than about 100 microns, less than about 50 microns, or less than 30 microns. In one embodiment hereof, the fibers have a diameter of from about 5 microns to about 25 microns. Fiber diameter is controlled by factors well known in the fiber spinning art including, for example, spinning speed and mass through-put.

The fibers produced in the present invention may be environmentally degradable depending upon the amount of starch that is present, the polymer used, and the specific configuration of the fiber. "Environmentally degradable" is defined being biodegradable, disintegratable, dispersible, flushable, or compostable or a combination thereof. In the present invention, the fibers, nonwoven webs, and articles may be environmentally degradable.

The fibers described herein are typically used to make disposable nonwoven articles. The articles are commonly flushable. The term "flushable" as used herein refers to materials which are capable of dissolving, dispersing, disintegrating, and/or decomposing in a septic disposal system such as a toilet to provide clearance when flushed down the toilet without clogging the toilet or any other sewage drainage pipe. The fibers and resulting articles may also be aqueous responsive. The term aqueous responsive as used herein means that when placed in water or flushed, an observable and measurable change will result. Typical observations include noting that the article swells, pulls apart, dissolves, or observing a general weakened structure.

The bicomponent fibers of the present invention can have low brittleness and have high toughness, for example a toughness of about 2 MPa or greater. Toughness is defined as the area under the stress-strain curve.

Extensibility or elongation is measured by elongation to break. Extensibility or elongation is defined as being capable of elongating under an applied force, but not necessarily recovering. Elongation to break is measured as the distance the fiber can be stretched until failure. It has also been found that the fibers of the present invention can be highly extensible.

The elongation to break of single fibers are tested according to ASTM standard D3822 except a strain rate of 200%/min is used. Testing is performed on an MTS Synergie 400 tensile testing machine with a 10 N load cell and pneumatic grips. Tests are conducted at a rate of 2 inches/minute on samples with a 1-inch gage length. Samples are pulled to break. Peak stress and % elongation at break are recorded and averaged for 10 specimens.

Nonwoven products produced from multicomponent fibers can also exhibit desirable mechanical properties, particularly, strength, flexibility, softness, and absorbency. Measures of strength include dry and/or wet tensile strength. Flexibility is related to stiffness and can attribute to softness. Softness is generally described as a physiologically perceived attribute which is related to both flexibility and texture. Absorbency relates to the products' ability to take up fluids as well as the capacity to retain them.

(4) Processes

The first step in producing a multi-component fiber can be a compounding or mixing step. In this compounding step, the raw materials are heated, typically under shear. The shearing in the presence of heat will result in a homogeneous melt with proper selection of the composition. The melt is then placed in an extruder where fibers are formed. A collection of fibers is combined together using heat, pressure, chemical binder, mechanical entanglement, and combinations thereof resulting in the formation of a nonwoven web. The nonwoven is then assembled into an article.

Compounding

The objective of the compounding step is to produce a homogeneous melt composition for each component of the fibers. Preferably, the melt composition is homogeneous, meaning that a uniform distribution of ingredients in the melt is present. The resultant melt composition(s) should be essentially free of water to spin fibers. Essentially free is defined as not creating substantial problems, such as causing bubbles to form which may ultimately break the fiber while spinning. The free water content of the melt composition can be about 1% or less, about 0.5% or less, or about 0.15% of less. The total water content includes the bound and free water. Preferably, the total water content (including bound water and free water) is about 1% or less. To achieve this low water content, the starch or polymers may need to be dried before processed and/or a vacuum is applied during processing to remove any free water. The thermoplastic starch, or other components hereof, can be dried at elevated temperatures, such as about 60° C., before spinning. The drying temperature is determined by the chemical nature of a component's constituents. Therefore, different compositions can use different drying temperatures which can range from 20° C. to 150° C. and are, in general, below the melting temperature of the polymer. Drying of the components may be in series or as discrete steps combined with spinning., such as those known in the art.

In general, any method known in the art or suitable for the purposes hereof can be used to combine the ingredients of the components of the present invention. Typically such techniques will include heat, mixing, and pressure. The particular order or mixing, temperatures, mixing speeds or time, and equipment can be varied, as will be understood by those skilled in the art, however temperature should be controlled such that the starch does not significantly degrade. The resulting melt should be homogeneous.

A suitable method of mixing for a starch and plasticizer blend is as follows:

1. The starch is destructured by addition of a plasticizer. The plasticizer, if solid such as sorbitol or mannitol, can be added with starch (in powder form) into a twin-screw extruder. Liquids such as glycerine, can be combined with the starch via volumetric displacement pumps.
2. The starch is fully destructurized by application of heat and shear in the extruder. The starch and plasticizer mixture is typically heated to 120–180° C. over a period of from about 10 seconds to about 15 minutes, until the starch gelatinizes.
3. A vacuum can applied to the melt in the extruder, typically at least once, to remove free water. Vacuum can be applied, for example, approximately two-thirds of the way down the extruder length, or at any other point desired by the operator.
4. Alternatively, multiple feed zones can be used for introducing multiple plasticizers or blends of starch.
5. Alternatively, the starch can be premixed with a liquid plasticizer and pumped into the extruder.

As will be appreciated by one skilled in the art of compounding, numerous variations and alternate methods and conditions can be used for destructuring the starch and formation of the starch melt including, without limitation, via feed port location and screw extruder profile.

A suitable mixing device is a multiple mixing zone twin screw extruder with multiple injection points. The multiple injection points can be used to add the destructurized starch and the polymer. A twin screw batch mixer or a single screw extrusion system can also be used. As long as sufficient mixing and heating occurs, the particular equipment used is not critical.

An alternative method for compounding the materials comprises adding the plasticizer, starch, and polymer to an extrusion system where they are mixed in progressively increasing temperatures. For example, in a twin screw extruder with six heating zones, the first three zones may be heated to 90°, 120°, and 130° C., and the last three zones will be heated above the melting point of the polymer. This procedure results in minimal thermal degradation of the starch and for the starch to be fully destructured before intimate mixing with the thermoplastic materials.

An example of compounding destructured thermoplastic starch would be to use a Werner &Pfleiderer 30 mm diameter 40:1 length to diameter ratio co-rotating twin-screw extruder set at 250 RPM with the first two beat zones set at 50° C. and the remaining five heating zones set 150° C. A vacuum is attached between the penultimate and last heat section pulling a vacuum of 10 atm. Starch powder and plasticizer (e.g., sorbitol) are individually fed into the feed throat at the base of the extruder, for example using mass-loss feeders, at a combined rate of 30 lbs/hour (13.6 kg/hour) at a 60/40 weight ratio of starch/plasticizer. Processing aids can be added along with the starch or plasticizer. For example, magnesium stearate can be added at a level of 0–1%, by weight, of the thermoplastic starch component.

Spinning

The fibers of the present invention can be made by melt spinning. Melt spinning is differentiated from other spinning, such as wet or dry spinning from solution, where in such alternate methods a solvent is present in the melt and is eliminated by volatilizing or diffusing it out of the extrudate.

Spinning temperatures for the melts can range from about 105° C. to about 250° C., and in some embodiments can be from about 130° C. to about 230° C. The processing temperature is determined by the chemical nature, molecular weights and concentration of each component.

In general, high fiber spinning rates are desired for the present invention. Fiber spinning speeds of about 10 meters/minute or greater can be used. In some embodiments hereof, the fiber spinning speed is from about 100 to about 7,000 meters/minute, or from about 300 to about 3,000 meters/minute, or from about 500 to about 2,000 meters/minute.

The fiber may be made by fiber spinning processes characterized by a high draw down ratio. The draw down ratio is defined as the ratio of the fiber at its maximum diameter (which is typically occurs immediately after exiting the capillary of the spinneret in a conventional spinning process) to the final diameter of the formed fiber. The fiber draw down ratio via either staple, spunbond, or meltblown process will typically be 1.5 or greater, and can be about 5 or greater, about 10 or greater, or about 12 or greater.

Continuous fibers can be produced through, for example, spunbond methods or meltblowing processes. Alternately, non-continuous (staple fibers) fibers can be produced according to conventional staple fiber processes as are well known in the art. The various methods of fiber manufacturing can also be combined to produce a combination technique, as will be understood by those skilled in the art. One skilled in the art would understand how hollow core fibers are produced, but U.S. Pat. No. 6,368,990 discusses some methods.

The fibers spun can be collected subsequent for formation using conventional godet winding systems or through air drag attenuation devices. If the godet system is used, the fibers can be further oriented through post extrusion drawing at temperatures from about 50° to about 200° C. The drawn fibers may then be crimped and/or cut to form non-continuous fibers (staple fibers) used in a carding, airlaid, or fluidlaid process.

In the process of spinning fibers, particularly as the temperature is increased above 105° C., typically it is desirable for residual water levels to be 1%, by weight of the fiber, or less, alternately 0.5% or less, or 0.15% or less.

Bicomponent melt spinning equipment is commercially available from, for example, Hills, Inc. located in Melbourne, Fla. USA. The Hills Inc. bicomponent spinning technology is presented in U.S. Pat. No. 5,162,074 and related family of patents. The spinneret capillaries in the present invention had an length-to-diameter ratio of 4 with a diameter of 0.350 mm, although other capillary dimensions can be used.

The process of spinning fibers and compounding of the components can be done in-line, with compounding, drying and spinning as a continuous process and can be the preferred process execution.

The residence time of each component in the spinline can have significance when a high melting temperature thermoplastic polymer is chosen to be spun with destructured starch. Spinning equipment can be designed to minimize the exposure of the destructured starch component to high process temperature by minimizing the time and volume of destructured exposed in the spinneret. For example, the polymer supply lines to the spinneret can be sealed and separated until introduction into the bicomponent pack. Furthermore, one skilled in the art of bicomponent fiber spinning will understand that the at least two components can introduced and processed in their separate extruders at different temperatures until introduced into the spinneret.

For example, consider bicomponent spinning of a sheath/core fiber with a destructured starch core and polypropylene sheath. The destructured starch component extruder profile may be 80° C., 150° C. and 150° C. in the first three zones of a three heater zone extruder with a starch composition similar to Example 4. The transfer lines and melt pump heater temperatures will also be 150° C. for the starch component. The polypropylene component extruder temperature profile would be 180° C., 230° C. and 230° C. in the first three zones of a three heater zone extruder. The transfer lines and melt pump are heated to 230° C. In this case the spinneret temperature can range from 180° C. to 230° C.

(5) Articles

The fibers hereof may be used for any purposes for which fibers are conventionally used. This includes, without limitation, incorporation into nonwoven substrates. The fibers hereof may be converted to nonwovens by any suitable methods known in the art. Continuous fibers can be formed into a web using industry standard spunbond type technologies while staple fibers can be formed into a web using industry standard carding, airlaid, or wetlaid technologies. Typical bonding methods include: calendar (pressure and heat), thru-air heat, mechanical entanglement, hydrodynamic entanglement, needle punching, and chemical bonding and/or resin bonding. The calendar, thru-air heat, and chemical bonding are the preferred bonding methods for the starch and polymer multicomponent fibers. Thermally bondable fibers are required for the pressurized heat and thru-air heat bonding methods.

The fibers of the present invention may also be bonded or combined with other synthetic or natural fibers to make nonwoven articles. The synthetic or natural fibers may be blended together in the forming process or used in discrete layers. Suitable synthetic fibers include fibers made from polypropylene, polyethylene, polyester, polyacrylates, and copolymers thereof and mixtures thereof. Natural fibers include cellulosic fibers and derivatives thereof. Suitable cellulosic fibers include those derived from any tree or vegetation, including hardwood fibers, softwood fibers, hemp, and cotton. Also included are fibers made from processed natural cellulosic resources such as rayon.

The fibers of the present invention may be used to make nonwovens, among other suitable articles. Nonwoven articles are defined as articles that contains greater than 15% of a plurality of fibers that are continuous or non-continuous and physically and/or chemically attached to one another. The nonwoven may be combined with additional nonwovens or films to produce a layered product used either by itself or as a component in a complex combination of other materials, such as a baby diaper or feminine care pad. Preferred articles are disposable, nonwoven articles. The resultant products may find use in one of many different uses. Preferred articles of the present invention include disposable nonwovens for hygiene and medical applications. Hygiene applications include such items as wipes; diapers, particularly the top sheet or back sheet; and feminine pads or products, particularly the top sheet.

EXAMPLES

The examples below further illustrate the present invention. The starches for use in the examples below are STARDRI 1, STARDRI 100, ETHYLEX 2015, or ETHYLEX 2035, all from Staley Chemical Co. The latter Staley materials are substituted starches. The ethylene acrylic acid (EAA) is PRIMACORE 59801 from Dow Chemical. The polypropylene (PP) resin is Basell PROFAX PH-835. The polyethylene (PE) is ASPUN 6811A from Dow Chemical. The poly(L) lactic acid is BIOMER L9000 (Biomer). The polyethylene succinate (PES) is BIONOLLE 1020 (Showa High Polymer). The sorbitol is from Archer-Daniels-Midland Co. (ADM), Crystalline NF/FCC 177440-2S. Other polymers having similar chemical compositions that differ in molecular weight, molecular weight distribution, and/or comonomer or defect level can also be used.

Comparative Example 1

Solid sheath/core bicomponent fiber composed of a PP sheath and a TPS core. The core is a blend of STAR DRI 1, sorbitol, magnesium stearate and EAA mixed in a ratio of 60:40:1:12, respectively. The PP sheath is Basell PROFAX PH-835. The bicomponent fiber is produced at a 30/70 sheath/core ratio (by weight) using a Hills Inc. 4-hole bicomponent system. The overall mass through is 0.6 grams per hole per minute (ghm). The fibers are attenuated using compressed air (i.e. Lurgi gun) to a final fiber diameter of 18 $\mu$m when melt spun into fibers via a continuous filament process at a melt extrusion temperature of 190° C.

The weight loss of the fibers is determined by placing approximately 1 g of uncrimped fibers enclosed in a copper mesh (roughly 100 mesh) suspended in 500 mL of water at 25° C. while being stirred with such force that a 1 cm deep vortex is created. The water with fibers is stirred for 60 minutes, after which time the fibers are removed and dried in the oven for 15 minutes at 115° C. The fibers are then removed from the oven and allowed to cool in an open atmosphere at room temperature for 30 minutes. Typically, when these fibers are placed in room temperature water, the core leaks through the sheath into the water causing a mass loss of the TPS component over time. The mass loss increases with increasing temperature to a point where greater than 75 wt % of the TPS component can be lost. Table 1 provides data for Comparative Example 1. Ranges are given to cover the breadth of observations that are made when measuring the TPS mass loss. No more than 100 wt % mass loss is possible. If the range given appears to exceed 100 wt %, the deviation extreme is taken to be less than the mean.

TABLE 1

| Water Temperature (° C.) | Exposure Time (min) | TPS Mass Loss (%) |
|---|---|---|
| 25 | 60 | 27 ± 10 |
| 50 | 60 | 55 ± 25 |
| 100 | 60 | 60 ± 40 |

Comparative Example 2

The core and sheath component compositions are as in Comparative Example 1. The fibers are produced on an Alex James bicomponent spinning system modified to use Hills Inc bicomponent spinning technology that has 82 holes. The fibers are attenuated using a winder and collected at 500 m/min. The fiber is then mechanically drawn to a diameter of 18 $\mu$m at a temperature of 90° C. The melt extrusion temperature of 190° C. is used for spinning. A hydrophilic surfactant supplied by Goulston Technologies (LUROL 9519) is used to coat the fiber during collection for the post spinning drawing process. The fibers are cut to 40 mm in length.

Table 2 provides data on TPS mass loss for Comparative Example 2.

TABLE 2

| Water Temperature (° C.) | Exposure Time (min) | TPS Mass Loss (%) |
|---|---|---|
| 25 | 60 | 35 ± 20 |
| 50 | 60 | 65 ± 30 |
| 100 | 60 | 65 ± 35 |

Comparative Examples 3–16

These examples repeat the studies of Comparative Examples 1 and 2, but at various sheath/core ratios and with various sheath materials. The samples are produced on the Alex James spin line system with similar process conditions as in Comparative Example 2. The TPS core in all cases is held constant and has the same composition as described in Comparative Examples 1 and 2. Table 3 provides data for Comparative Examples 3–16.

TABLE 3

| Comparative Example | Sheath Material | Core Material | S/C Ratio | Fiber Type | TPS Mass Loss @ 50° C. in $H_2O$ |
|---|---|---|---|---|---|
| 1 | BASELL PH-835 | TPS | 30/70 | Continuous | 55 ± 25 |
| 2 | BASELL PH-835 | TPS | 30/70 | Cut | 65 ± 25 |
| 3 | BASELL PH-835 | TPS | 10/90 | Continuous | 80 ± 40 |
| 4 | BASELL PH-835 | TPS | 50/50 | Continuous | 35 ± 20 |
| 5 | BIOMER L9000 | TPS | 30/70 | Continuous | 60 ± 30 |
| 6 | BIOMER L9000 | TPS | 30/70 | Cut | 65 ± 40 |
| 7 | BIOMER L9000 | TPS | 10/90 | Continuous | 90 ± 40 |
| 8 | BIOMER L9000 | TPS | 50/50 | Continuous | 50 ± 35 |
| 9 | BIONOLLE 1020 | TPS | 30/70 | Continuous | 60 ± 30 |
| 10 | BIONOLLE 1020 | TPS | 30/70 | Cut | 65 ± 40 |
| 11 | BIONOLLE 1020 | TPS | 10/90 | Continuous | 90 ± 40 |
| 12 | BIONOLLE 1020 | TPS | 50/50 | Continuous | 50 ± 35 |
| 13 | ASPUN 681lA | TPS | 30/70 | Continuous | 55 ± 25 |
| 14 | ASPUN 6811A | TPS | 30/70 | Cut | 65 ± 25 |
| 15 | ASPUN 6811A | TPS | 10/90 | Continuous | 80 ± 40 |
| 16 | ASPUN 6811A | TPS | 50/50 | Continuous | 35 ± 20 |

Comparative Examples 17–21

A blend of STAR DRI 1, sorbitol, magnesium stearate and EAA mixed in a ratio of 60:40:1:12, respectively, is compounded with 2 wt % stearic acid from Alfa Aesar (BK-08-01). This material does not spin well, but does have less water solubility that pure TPS. Table 4 provides data for Comparative Examples 17–21.

TABLE 4

| Comparative Example | Stearic Acid wt % Level | Spinnability | TPS Mass Loss @ 50° C. in $H_2O$ |
|---|---|---|---|
| 17 | 1 | Acceptable | 70 ± 25 |
| 18 | 3 | Poor | 25 ± 25 |
| 19 | 5 | Very Poor | 0 |
| 20 | 7 | Extremely Poor | 0 |
| 21 | 0 | Good | 95 ± 5 |

Examples 1–14

The same compositions and process conditions used in Comparative Examples 1–14 are used here, with the exception that the thermoplastic polymer component for the sheath is blended with various amounts of stearic acid, indicated in Table 5.

TABLE 5

| Example | Stearic Acid wt % Level | Sheath Material | Core Material | S/C Ratio | Fiber Type | TPS Mass Loss @ 50° C. in $H_2O$ |
|---|---|---|---|---|---|---|
| 1 | 3 | BASELL PH-835 | TPS | 30/70 | Continuous | 25 ± 25 |
| 2 | 5 | BASELL PH-835 | TPS | 30/70 | Continuous | 10 ± 10 |
| 3 | 5 | BASELL PH-835 | TPS | 10/90 | Continuous | 20 ± 20 |
| 4 | 5 | BASELL PH-835 | TPS | 50/50 | Continuous | 5 ± 40 |
| 5 | 3 | BIOMER L9000 | TPS | 30/70 | Continuous | 25 ± 25 |
| 6 | 5 | BIOMER L9000 | TPS | 30/70 | Cut | 10 ± 10 |
| 7 | 5 | BIOMER L9000 | TPS | 10/90 | Continuous | 20 ± 20 |
| 8 | 5 | BIOMER L9000 | TPS | 50/50 | Continuous | 5 ± 40 |
| 9 | 3 | BIONOLLE 1020 | TPS | 30/70 | Continuous | 25 ± 25 |
| 10 | 5 | BIONOLLE 1020 | TPS | 30/70 | Cut | 10 ± 10 |
| 11 | 5 | BIONOLLE 1020 | TPS | 10/90 | Continuous | 20 ± 20 |
| 12 | 5 | BIONOLLE 1020 | TPS | 50/50 | Continuous | 5 ± 40 |
| 13 | 3 | ASPUN 6811A | TPS | 30/70 | Continuous | 25 ± 25 |
| 14 | 5 | ASPUN 6811A | TPS | 30/70 | Cut | 10 ± 10 |

As the data in Examples 1–14 illustrate, significant reduction in TPS mass loss is achieved by addition of a starch insolubilization agent such as stearic acid to the sheath component of a multicomponent fiber. Not wanting to be bound by theory, the present inventor believes that the insolubilization agent diffuses across the interface boundary between the two components, thereby insolubilizing starch in the core component.

While particular embodiments of the present invention have been illustrated and described, it would be obvious to those skilled in the art that various other changes and modifications can be made without departing from the spirit and scope of the invention. It is intended to cover in the appended claims all such changes and modifications that are within the scope of the invention.

What is claimed is:

1. A melt spinnable multicomponent fiber comprising:

a first component comprising a starch insolubilizing agent and a thermoplastic polymer; and a second component comprising destructured starch and a plasticizer.

2. The melt spinnable multicomponent fiber of claim 1 wherein the starch insolubilizing agent is present in the first component in an amount of 0.1% to 15%.

3. A melt spinnable multicomponent fiber comprising:

a first component comprising a starch insolubilizing agent and a thermoplastic polymer; and a second component comprising destructured insolubilized starch and a plasticizer.

4. The melt spinnable multicomponent fiber of claim 3 wherein the fiber has a sheath-core configuration, the first component is an the sheath configuration and the second component is in the core configuration.

5. The melt spinnable multicomponent fiber of claim 3 wherein the fiber has a configuration selected from the group consisting of islands-in-the-sea, ribbon, segmented pie, side-by-side, and a combination thereof.

6. The melt spinnable multicomponent fiber of claim 3 wherein the starch insolubilizing agent is a C8–C22 aliphatic saturated or unsaturated carboxylic acid.

7. The melt spinnable multicomponent fiber of claim 6 wherein the aliphatic carboxylic acid is selected from the group consisting of stearic acid, oleic acid, and caprylic acid.

8. The melt spinnable multicomponent fiber of claim 7 wherein the aliphatic carboxylic acid is stearic acid.

9. The melt spinnable multicomponent fiber of claim 3 wherein the thermoplastic polymer is selected from the group consisting of polypropylene, polyethylene, polyamide, polyvinyl alcohol, polyolefin copolymer, polyolefin carboxylie acid copolymer, ethylene acrylic acid, polyester, and a combination thereof.

10. The melt spinnable multicomponent fiber of claim 3 wherein the thermoplastic polymer is biodegradable.

11. The melt spinnable multicomponent fiber of claim 10 wherein the thermoplastic polymer has a molecular weight of less than 500,000 g/mol.

12. The melt spinnable multicomponent fiber of claim 10 wherein the biodegradable thermoplastic polymer is selected from a group consisting of a homopolymer or copolymer of crystallizable polylactic acid, a diacid/diol aliphatic polyester, an aliphatic/aromatic copolyester, and a combination thereof.

13. The melt spinnable multicomponent fiber of claim 3 having a sheath-core configuration and wherein the first component is in a core configuration; and the second component is in a sheath configuration.

14. The melt spinnable multicomponent fiber of claim 3 having an islands-in-the-sea configuration wherein the first component is in a sea configuration and a second component is in an island configuration.

15. The melt spinnable multicomponent fiber of claim 3 having an islands-in-the-sea configuration wherein the first component is in an island configuration and the second component is in a sea configuration.

16. A melt spinnable multicomponent fiber produced by a process comprising:

compounding a first component comprising a starch insolubiizing agent and a thermoplastic polymer;

compounding a second component comprising destructured starch and a plasticizer, and contacting the first component with the second component to form a fiber.

17. The melt spinnable multicomponent fiber of claim 16 wherein the starch insolubilizing agent is a C8–C22 aliphatic saturated or unsaturated carboxylic acid.

18. A melt spinnable multicomponent fiber of claim 16 wherein the second component is an outer component, the fiber produced by a process further comprising:

contacting the fiber with a solvent so as to remove starch not insolubilized by the insolubilizing agent thereby providing a fiber having a first component with a coating of insolubilized starch.

* * * * *

UNITED STATES PATENT AND TRADEMARK OFFICE

CERTIFICATE OF CORRECTION

PATENT NO. : 6,830,810 B2
DATED : December 14, 2004
INVENTOR(S) : Bond

It is certified that error appears in the above-identified patent and that said Letters Patent is hereby corrected as shown below:

Title page,
Item [*] Notice, should read as follows:
-- [*] Notice: Subject to any disclaimer, the term of this patent is extended or adjusted under 35 U.S.S. 154(b) by 58 days.

This patent is subject to a terminal disclaimer. --.

Signed and Sealed this

Sixth Day of September, 2005

JON W. DUDAS
*Director of the United States Patent and Trademark Office*